United States Patent [19]

Ichidate et al.

[11] 4,385,929

[45] May 31, 1983

[54] METHOD AND APPARATUS FOR PRODUCTION OF METAL POWDER

[75] Inventors: Minoru Ichidate; Toshihiko Kubo, both of Amagasaki, Japan

[73] Assignee: Sumitomo Metal Industries Limited, Osaka, Japan

[21] Appl. No.: 275,506

[22] Filed: Jun. 19, 1981

[51] Int. Cl.[3] ..... B22F 9/08

[52] U.S. Cl. ..... 75/0.5 C; 264/7; 264/12; 34/10; 148/16.5; 148/126.1

[58] Field of Search ..... 75/0.5 C, 0.5 R; 264/11, 12, 7; 425/6, 7; 148/126, 16, 20.3; 34/10, 57 A

[56] References Cited

U.S. PATENT DOCUMENTS

| | | | |
|---|---|---|---|
| 3,764,295 | 10/1973 | Lindskog et al. | 75/0.5 BA |
| 3,887,402 | 6/1975 | Kondo et al. | 148/126 |
| 3,900,309 | 8/1975 | Chao et al. | 75/0.5 BA |
| 4,124,377 | 11/1978 | Larson | 75/0.5 C |
| 4,236,318 | 12/1980 | Heard et al. | 34/10 |
| 4,238,427 | 12/1980 | Chisholm | 264/7 |
| 4,245,395 | 1/1981 | Potter | 34/10 |
| 4,300,291 | 11/1981 | Heard et al. | 34/10 |

FOREIGN PATENT DOCUMENTS 51997 11/1969 Romania .

OTHER PUBLICATIONS

Domsa, A., Berkovitz, S., "Investigations Concerning the Manufacture of Oxidizable Metal Powder by Atomization", International Powder Metal Conference, pp. 301-311, 1974.

*Primary Examiner*—L. Dewayne Rutledge
*Assistant Examiner*—Christopher N. Brody
*Attorney, Agent, or Firm*—Watson, Cole, Grindle & Watson

[57] ABSTRACT

A metal powder of improved quality is obtained by causing molten metal held in a vessel to flow out in a smooth stream through an outlet formed at the bottom of the vessel, throwing the jet of an atomizing medium consisting of nonpolar solvents such as mineral oils, or animal and vegetable oils against the stream of molten metal thereby atomizing the molten metal, separating and recovering the produced metal powder and the used atomizing medium by means of a fluidized bed furnace, and if necessary subjecting the metal powder to decarburization and softening anneal. In this production, the molten metal, the path for the flow of the molten metal, and the produced metal powder are substantially insulated from the atmospheric air.

13 Claims, 6 Drawing Figures

METHOD AND APPARATUS FOR PRODUCTION OF METAL POWDER

BACKGROUND OF THE INVENTION

1. Field of the Invention

This invention relates to a method and apparatus for the production of metal or alloy powder (hereinafter referred to collectively as "metal powder") by atomizing molten metal.

2. Description of the Prior Art

The metal powder which is used as the raw material for powder metallurgical articles such as powder-sintered articles and powder-forged articles generally is required to possess the following attributes:

(1) The metal powder should have a low oxygen content and sparingly yield to surface oxygen.

(2) The metal powder should have a proper particle size distribution and contain finely divided particles in a proportion above a certain level.

(3) The individual particles of the metal powder should have irregular shapes.

As ways for producing metal powder, many methods ranging from mechanical methods to chemical methods have been introduced to the art. Among other methods, the so-called atomizing method, i.e., a method by which a stream of molten metal is reduced into finely divided particles by the force of an injected current of water or gas has found widespread acceptance owing to its advantage in terms of the properties of the metal powder produced, and to the efficiency and cost of the production technique. However, considering the aforementioned conditions the metal powder is required to fulfill, the water atomizing method and the gas atomizing method have various problems of their own, as indicated below.

The water atomizing method effects the reduction of molten metal into finely divided particles by a jet of water. In the course of this atomization, the divided particles of metal undergo surface oxidation by the ambient air and the water from the jet. When this method is carried out on molten iron in an air atmosphere, for example, oxygen in an amount of about 3 to 5% based on the weight of iron being atomized reacts with the iron to produce iron oxide. It is known that oxygen in an amount of about 0.2 to 0.5% inevitably reacts with the iron even when the atomization is carried out in an inner gas atmosphere and an ingenius device is used for the injection of the atomizing agent. To permit production of shaped articles of high mechanical properties, the metal powder obtained by the water atomizing method must be given an additional reducing treatment before it is put to use.

This reduction necessitates provision of such a reducing substance such as $H_2$ or CO and requires the ambient temperature to be elevated above 1000° C. The equipment for reduction is composed of heating facilities, facilities for powder transfer, facilities for preparation of a reducing gas, and cooling facilities. The cost for the provision of the reducing gas and for the elevation of ambient temperature accounts for a high proportion of 20 to 30% of the total cost of equipment. Use of these extra facilities constitutes one of the factors for increasing the price of the metal powder itself and the price of shaped articles obtained from the metal powder as the raw material.

In the case of the atomizing method using a gaseous agent, the possible oxidation during the production of metal powder may be precluded by using a non-oxidizing gas such as inert gas, neutral gas, or reducing gas in high purity. The aforementioned reducing treatment, therefore, can be omitted. Nevertheless, this method entails the following problem.

For the convenience of cold forming, the metal powder is required to meet the condition that the individual particles of the powder should possess surface shapes irregular to a certain degree as mentioned above. According to the gas atomizing method, however, since the gas has low specific heat and density, no sufficient cooling speed can be obtained. Consequently, the atomized particles of molten metal, while being cooled, are caused by surface tension to convert themselves into smooth spheres. The metal powder thus made up of spheres of smooth surface has a disadvantage that it exhibits poor cold formability and fails to give compressed powder of sufficient strength and produce sintered articles of ample strength.

Recently, there have been several proposals for a method of using oil as an atomizing medium, the proposals of which being, for example, U.S. Pat. No. 4,124,377 to Larson, Rumanian Pat. No. 51,997, and Int. Powder Metall Conf. (U.S.A.) 301 to 311 ('74).

The oil atomizing method, which uses a varying kind of oil instead of gas or water, enjoys a high cooling efficiency and removes the possibility that the powder particles will be exposed to oxidation. This method, nevertheless, is susceptible to the following problems and is not yet practically used.

(1) When the molten metal is atomized with an oil, there is required an additional treatment for separating and recovering the oil adhering to the divided particles of the metal.

(2) The oil, on contact with the molten metal at a high temperature, is decomposed to produce a carburizing atmosphere, with the result that the produced metal powder acquires an increased carbon content. As a result, the product is made so hard as to be considerably difficult to exhibit cold formability.

SUMMARY OF THE INVENTION

An object of this invention is to provide a method and apparatus for inexpensively mass-producing on an industrial scale a metal powder having a notably low oxygen content, possessing desirable irregularity of particle shapes, and exhibiting outstanding cold formability, by utilizing the advantage of the atomizing methods and eliminating the disadvantage of the conventional methods using water, a gas, or an oil as the atomizing medium.

Another object of this invention is to provide a method and apparatus for the production of a metal powder which embraces a step for separating and recovering efficiently the atomizing medium from the finely divided particles of metal and further a step for giving the powder a heat treatment for decarburization and/or softening anneal.

The method for the production of a metal powder provided by this invention is mainly characterized by a nonpolar solvent such as a mineral oil, or an animal or vegetable oil as the atomizing medium, keeping the molten metal and the atomized particles of metal completely insulated from the ambient air, and utilizing a fluidized bed furnace for the separation of the used atomizing medium from the atomized particles of metal and for the heat treatment of the metal powder.

The reason for the adoption of a non-polar solvent is that in the case of a polar solvent possessing S or a —OH group, for example, the solvent, upon contact with the molten metal, undergoes decomposition and consequently emits S, a possible cause for contamination, and O, a possible cause for oxidation.

When water is used as the atomizing medium, the oxidation of the metal powder by steam issuing from the water is inevitable as described above even when the atomization is carried out in an atmosphere insulated from the atmospheric air. It has been confirmed that when a non-polar solvent such as a mineral oil, or an animal or vegetable oil is used as the atomizing medium, the possibility of the metal powder being oxidized by the atomizing medium is very remote. When the molten metal awaiting the atomizing treatment or the atomized particles of metal particularly in a state not yet completely cooled are exposed to an atmosphere containing oxygen, surface oxidation and the invasion of oxygen into the particles are inevitable consequences.

For successful working of this invention, the use of the specific atomizing medium and the perfect insulation of the ambience of atomization from the atmospheric air are indispensable conditions. Further, since the atomizing medium to be used in this invention has much higher specific heat and density than the atomizing media heretofore used in the gas atomizing method, the produced particles of molten metal enjoy a notably high cooling speed. Consequently, the possibility of the divided particles of molten metal being converted into smooth spheres as described above is remote. The divided particles of molten metal, therefore, assume irregular shapes similarly to the metal powder produced by the atomizing method using water as the atomizing medium. The produced metal powder is favorably comparable in terms of cold formability with that obtained by the water atomizing method.

As non-polar solvent, mineral oil, particularly, quenching oil, machine oil or turbine oil is the most preferable in practice. The above-mentioned oil can be obtained at relatively inexpensive price. The quenching oil is not necessary to be especially prepared to be used for quenching the ordinary steel. No special preparation is either necessary for the machine oil or turbine oil. In order to prevent a carburization to the metal powder when atomizing, the above-mentioned oil may contain a carburization preventive, for example, a small amount of water of esters.

For the insulation of the molten metal from the atmospheric air, a measure which involves giving to the container of the molten metal an airtight construction and filling the space remaining in the container with a non-oxidizing gas such as a neutral gas, a reducing gas, or an inert gas can be used. Particularly, $N_2$ gas proves to be practical.

The path used for conveying the molten metal from the container to the atomizing unit also is required to be similarly insulated from the atmospheric air. Further, the projection of the atomizing medium is required to be carried out in a closed, airtight vessel filled with a non-oxidizing gas such as a neutral gas, a reducing gas or an inert gas.

The atomized particles of metal and the used atomizing medium are stored inside the aforementioned airtight vessel. The separation of the produced metal powder from the used atomizing medium is accomplished by heating the powder with the atomizing oil and thereby selectively gasifying the atmozing medium.

The inventors made a study in search of a method capable of effecting the separation of the used atomizing medium with improved efficiency without entailing the possibility of exposing the metal powder to oxidation. The inventors have consequently found that a fluidizing furnace using a non-oxidizing gas is exceptionally effective in carrying out this separation.

Generally, the metal powder to be produced by the atomizing method is destined to undergo a rapid cooling. Therefore, in the case of a Fe type metal powder, for example, the produced metal powder has high hardness and consequently poor cold formability. The metal powder of such nature, therefore, must be softened by a proper heat treatment after it has been isolated from the used atomized medium. This softening treatment is not always required to be carried out within the line of the metal powder production. No special device is needed for the heat treatment. However, if this softening treatment is carried out in the aforementioned fludized bed furnace immediately after the separation of the metal powder from the used atomizing medium, it ought to prove highly advantageous from the standpoint of utility of heat. Further, if a fluidized bed furnace using a non-oxidizing gas is additionally adopted as the device for the softening heat treatment, then the treatment can be efficiently performed without breaking the continuity of the whole operation of the metal powder production. When the non-polar solvent, for example, mineral oil, is used as an atomized medium, the carburization of the powder may take place. Therefore, the decarburization treatment other than the softening treatment may sometimes be required. When said softening decarburing gas such as $H_2$—$H_2O$ and CO—$CO_2$, the metal powder can be simultaneously softened and decarburized.

DETAILED DESCRIPTION OF THE INVENTION

Figure 1:
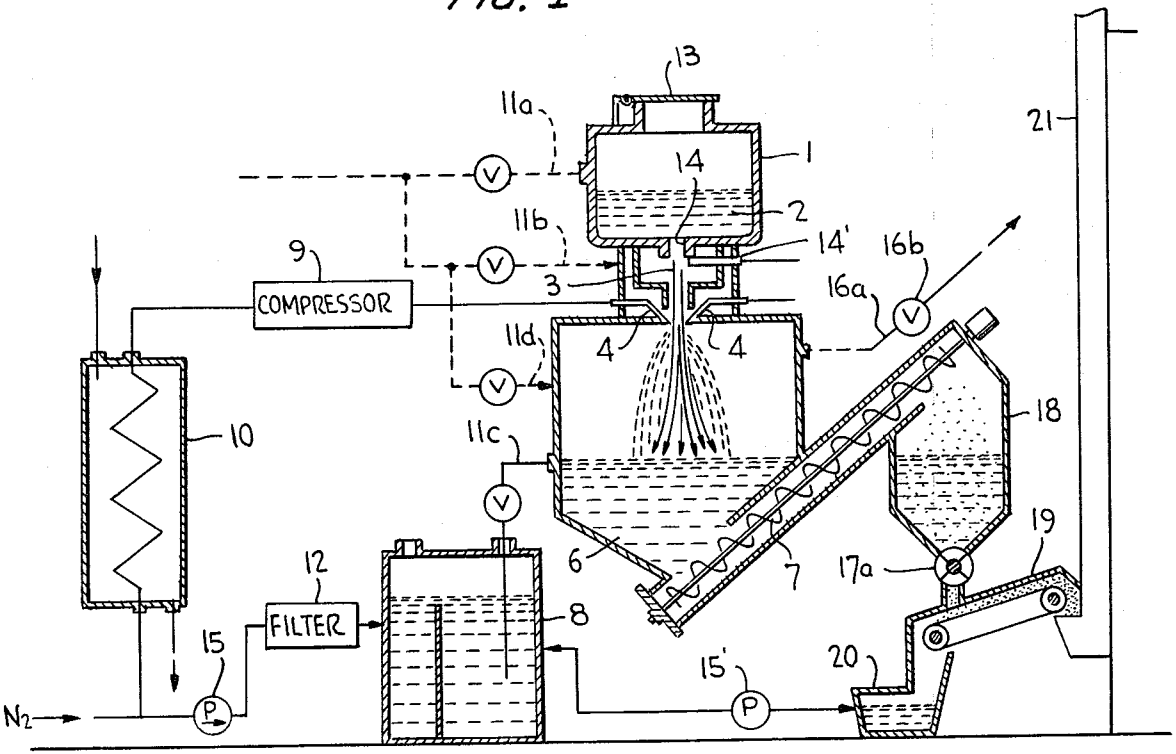
FIG. 1 and FIG. 2 are explanatory diagrams illustrating one typical apparatus of this invention for the production of a metal powder from molten metal.
Figure 2:
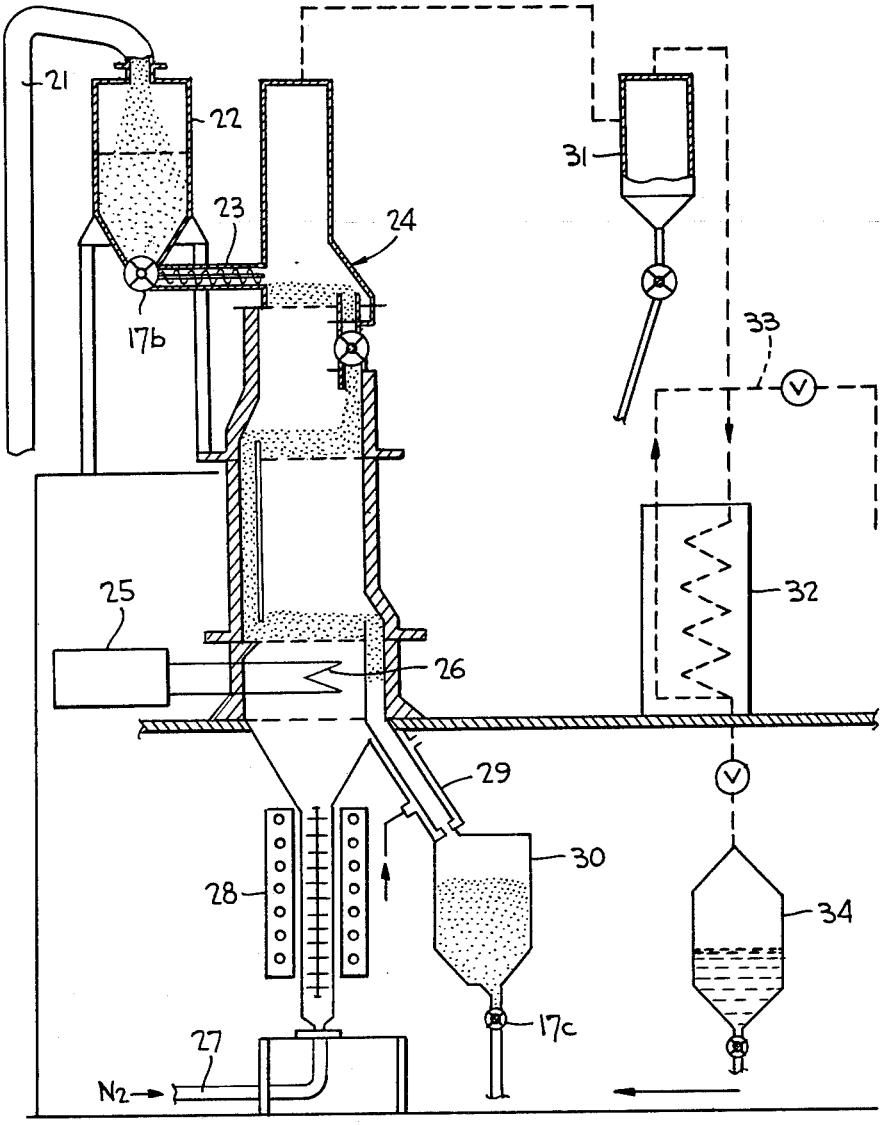
Figure 3:
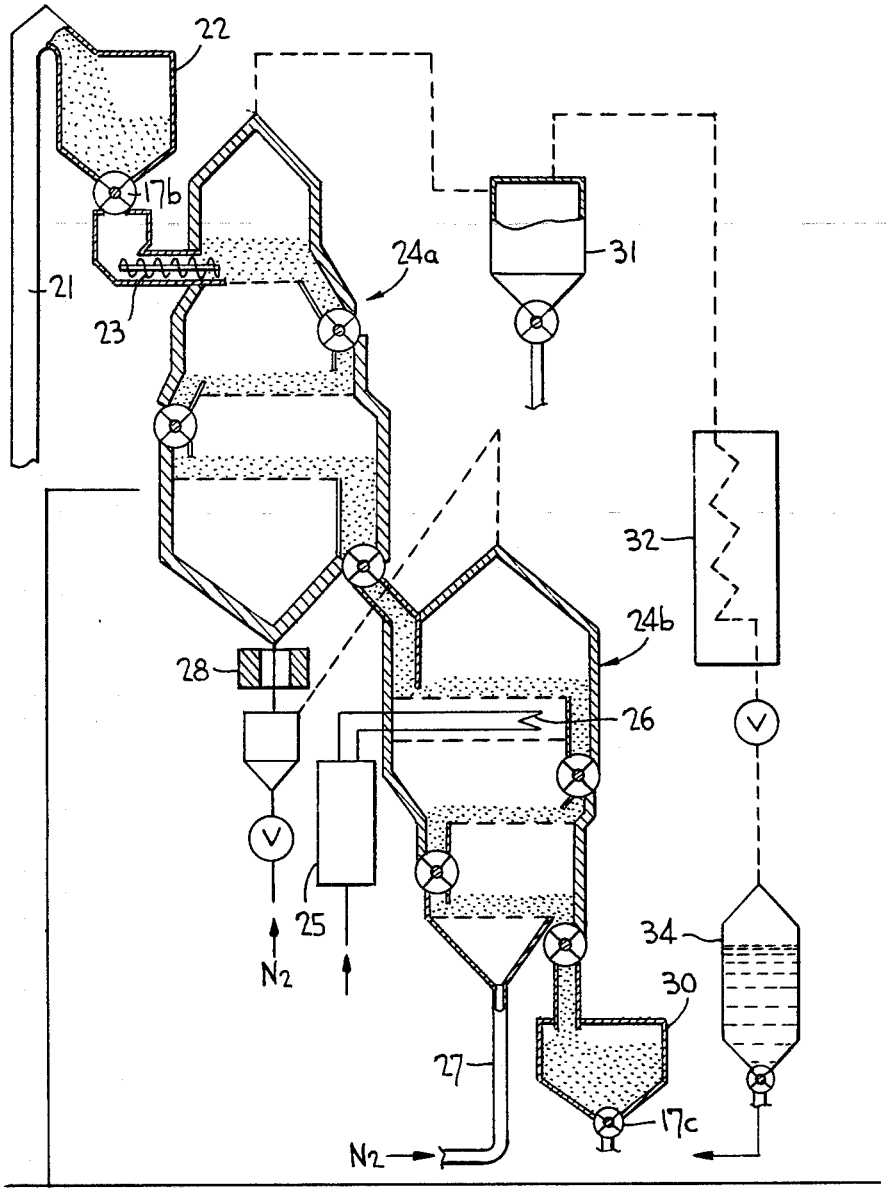
FIG. 3 is a modified version of the apparatus illustrated in FIG. 2.

FIG. 1 is a diagram illustrating an apparatus of this invention for the production of a metal powder, with emphasis on the atomizing unit, FIG. 2 is a diagram illustrating a unit for the separation of the produced metal powder from the used atomizing medium and a unit for giving the metal powder a heat treatment, and FIG. 3 is a diagram illustrating a modified version of the units for the separation and heat treatment of the metal powder of FIG. 2.

Referring to FIG. 1 and FIG. 2, a vessel (1) for receiving molten metal (2) is insulated by a sealed valve (13) from the atmospheric air and is provided with a non-oxidizing gas feed pipe **(11*a*). This vessel is provided in the bottom thereof with a drawing hole (14)**

adapted to allow the molten metal to flow down in a suitable stream (3). By (14') is denotes a device for opening and closing the drawing hole (14).

The space between the drawing hole (14) and a granulation tank (5) disposed thereunder is enclosed with a structure which is also insulated from the atmospheric air, and the interior of this structure is filled with a non-oxidizing gas supplied via a gas feed pipe (11*b*). Denoted by (4) is an atomizing medium injecting nozzle which injects the atomizing medium highly compressed by a compressor (9) against the stream of molten metal so as to atomize the molten metal. The atomized molten metal is quenched, solidified, and dropped to the bottom of the granulation tank (5), there to be sedimented and accumulated. The granulation tank (5) is also in an airtight construction. Prior to the operation of the apparatus, the air in the interior of the granulation tank is displaced with the non-oxidizing gas introduced through a gas feed pipe (11*d*). Denoted by (16*a*) is a pipe for suitably discharging the non-oxidizing gas accumulated during the operation. This pipe (16*a*) is provided with a pressure regulating valve (16*b*) adapted to control the pressure inside the granulation tank (5).

Owing to the construction described above, all the steps of operation through which the molten metal is converted to a metal powder are carried out in a conditions insulated from the atmospheric air. The used atomizing medium (6) which collects in the granulation tank (5) is withdrawn through a discharge pipe (11*c*), then circulated by a circulation pump (15) through a thickener (8), a filter (12), and a cooler (10), and then mixed with a freshly supplied atomizing medium and put to use.

In the meantime, the metal powder is removed from the granulation tank (5) by means of a classifier (7) and then received in a hopper (18).

In the hopper, part of the atomizing medium adhering to the metal powder is separated, placed in a storage tank (20), and returned via a circulation pump (15') to the thickener (8). The atomizing medium remaining on the surface of the metal powder is thoroughly removed in the next step. In the embodiment illustrated in FIG. 2, a fluidized bed furnace (24) is used for this step.

The metal powder which has departed from the hopper (18) of FIG. 1 is released in a flow rate adjusted by a valve (17*a*) onto a belt conveyer (19), scooped in a bucket elevator (21) and delivered to an upper hopper (22), forwarded in a prescribed amount adjusted by a valve (17*b*) through a screen feeder (23), and introduced into a fluidized bed furnace (24). The fluidized bed furnace (24) is capable of simultaneously the gasification and separation of the used atomizing medium and the heat treatment of the metal powder. The upper two stages of the fludized bed furnace are used for the step of separation and the third stage for the step of heat treatment. By (26) is denoted indirect heating means for ensuring supply of heat necessary for the heat treatment and for the gasification and separation mentioned above. The indirect heating means is supplied with a hot combustion gas produced in a hot stove (25). To the interior of the fluidized bed furnace is supplied a non-oxidizing gas such as, for example, $N_2$ gas which has been brought in through a feed pipe (27) disposed at the lowermost level and then passed through a preheater furnace (28). The preheated gas ascends the stages of the fluidized bed furnace while exchanging heat with the metal powder. The metal powder is cooled while it is moving from the lowermost stage of the furnace through a cooling pipe (29). It is then forwarded through a product hopper (30) and discharged through a rotary valve (17*c*). The non-oxidizing gas is forwarded through a dust catcher (31) and an oil recovery cooler (32) and then circulated by a pipe (33) to the feed pipe (27) leading to the fluidized bed furnace. Within the oil recovery cooler (32), the atomizing medium in the gas is condensed and the condensed atomizing medium is stored in an oil recovery tank (34) and then lead to the thickener (8) of FIG. 1.

Optionally, the metal powder may be decarburized by adding a decarburizing agent into the non-oxidizing gas to be delivered through the feed pipe (27).

The embodiment of FIG. 2 represents a case in which the fluidized bed furnace has a three-stage construction and serves the purpose of simultaneously effecting the gasification and separation of the atomizing medium and the heat treatment of the metal powder. This fluidized bed furnace need not be limited to three stages as described above but may be designed in a construction of a larger number of stages to meet the convenience of the operation involved.

Crude separation of the metal powder and the used atomizing medium may be performed as by means of a centrifugal separator between the production of metal powder and the separation of the solvent by the fluidized bed furnace.

Increasing the number of fluidized bed furnaces used in the apparatus implies moderating the operations of separation of the metal powder and the used atomizing medium and softening of the metal powder and thereby promising high quality for the product.

The fluidized bed furnace (24) in the embodiment of FIG. 2 may be adapted to effect exclusively the separation of the metal powder and the used atomizing medium. The softening heat treatment may be performed in a separate fluidized bed furnace or a furnace of some other design.

FIG. 3 illustrates another embodiment in which a furnace (24*a*) used exclusively for the gasification and separation of the used atomizing medium and a furnace (24*b*) for the heat treatment of the metal powder are incorporated in the place of a single fluidized bed furnace used in the foregoing embodiment. The functions fulfilled by the component parts of these separate furnaces are identical to those in the apparatus of FIG. 2.

[EXAMPLE I]

A steel powder was produced by using an apparatus of the construction illustrated in FIG. 1 and FIG. 2. The particulars of the apparatus were as shown in Table 1. The chemical composition of the molten steel is shown in Table 2.

The atomization of molten steel was carried out under the conditions shown below.

| | |
|---|---|
| Temperature of molten steel: | 1610° C. |
| Amount of molten steel used: | 30 kg |
| Kind of atomizing medium used: | Quenching oil (containing a carburization preventive) |
| Pressure of atomization: | 140 kg/cm$^2$ |
| Atomizing rate: | 200 lit./min. |

TABLE 1

Particulars of apparatus for the production of steel powder

| Step of operation | | Device | Specification |
|---|---|---|---|
| Atomization | Vessel for keeping molten steel | Inner volume | 250 mmϕ × 250 mmL |
| | | Diameter of drawing hole for molten steel | 8 mmϕ |
| | Atomizing nozzle | Type | Conical |
| | | Diameter of orifice for molten metal injection | 30 mm |
| Separation of oil and softening of metal powder | | First fluidized bed | 0.11 $m^2$ |
| | | Second fluidized bed | 0.165 $m^2$ |
| | | Third fluidized bed | 0.32 $m^2$ |

TABLE 2

Chemical composition of molten steel (% by weight)

| C | Si | Mn | P | S | O |
|---|---|---|---|---|---|
| 0.010 | 0.03 | 0.25 | 0.15 | 0.012 | 0.015 |

TABLE 3

Conditions for removal of oil and softening of metal powder

| Item | | Condition |
|---|---|---|
| Temperature of heating | First fluidized bed | 250° C. |
| | Second fluidized bed | 480° C. |
| | Third fluidized bed | 850° C. |
| Feed rate of steel powder | | 20 kg/hr |
| Flow volume of $N_2$ gas | | 10 $Nm^3$/hr |

The steel powder produced under the conditions indicated above was subjected to the treatment for the gasification and separation of the atomizing medium, namely, quenching oil, from the steel powder and to the softening heat treatment of the steel powder under the conditions indicated in Table 3.

In this case, the amount of the molten steel subjected to the production of steel powder totalled 120 kg, which was atomized in four separate batch operations. The treatments involved were performed continuously over a period of six hours. The individual particles of the steel powder thus produced thus produced had irregular shapes abounding in abrupt rises and falls and hardly resembling those spherical, smooth particles illustrated in Photo. 1 (400 magnifications). These irregular shapes are similar to those of the particles of steel powder produced by the conventional water atomizing method. Such irregular shapes are most desirable for the purpose of forming works which the steel powder is destined to undergo.

The steel powder produced as described was tested for chemical composition and particle size distribution. The results of the test were as shown in Table 4.

TABLE 4

Chemical composition and particle size distribution

| Chemical composition % by weight | C 0.15 | Si 0.01 | Mn 0.23 | P 0.013 | S 0.015 | O 0.048 |
|---|---|---|---|---|---|---|
| Particle size (mesh) | +60 | 60 ~ 100 | 100 ~ 150 | 150 ~ 200 | 200 ~ 250 | 250 ~ 350 | −350 |
| Distribution (%) | 0.3 | 6.3 | 16.4 | 21.3 | 13.5 | 16.5 | 25.7 |

The steel powder produced by the method of this invention had an oxygen content of 0.048%, a value notably lower than the oxygen content found in the steel powder obtained by the conventional water atomizing method. For example, the oxygen content in the steel powder produced by the conventional water atomizing method generally exceeds 0.1% even after reduction with hydrogen. The particle size distribution of the steel powder of this invention was substantially the same as that of the steel powder produced by the other method.

The carbon content increases up to 0.15%. Even with such the increase as to 0.15% the desired formability can be obtained by the softening anneal.

[EXAMPLE II]

By using the same apparatus under the same atomizing conditions (except for use of a quenching oil without carburization preventive as the atomizing medium) as involved in Example I, molten steel indicated in Table 5 was treated to produce a steel powder. The steel powder produced was subjected to crude separation of the oil by use of a centrifugal separator and then subjected to a simultaneous treatment for oil removal, softening anneal and decarburization in a multi-stage fluidized bed furnace illustrated in FIG. 2. The conditions of the treatment were identical to those of Table 3, except for the composition of the fluidizing gas (Table 6).

TABLE 5

Chemical composition of molten steel and steel powder (wt %)

| | C | Si | Mn | Cr | P | S | O |
|---|---|---|---|---|---|---|---|
| Molten steel | 0.01 | 0.02 | 0.25 | 0.30 | 0.015 | 0.012 | 0.015 |
| Steel powder (before treatment in fluidized bed furnace) | 0.50 | 0.01 | 0.24 | 0.30 | 0.015 | 0.016 | 0.020 |
| Steel powder (after treatment in fluidized bed furnace) | 0.02 | 0.01 | 0.23 | 0.30 | 0.015 | 0.015 | 0.048 |

The chemical compositions of the steel powder before and after the treatment of the steel powder in the fluidized bed furnace are also shown in Table 5.

TABLE 6

Feed volume of fluidizing gas

| Total amount of gas used | 11 $N_{m3}$/hr |
|---|---|
| $N_2$ gas | 4.7 $N_{m3}$/hr |
| $N_2$ gas | 4.7 $N_{m3}$/hr |
| $N_2O$ gas | 1.6 $N_{m3}$/hr |

It is noted from Table 5 that the C content which was increased to 0.50% by the atomization was lowered to 0.02% by the treatment with a fluidizing gas containing a decarburizing gas. According to this invention, therefore, the steel powder can be carburized by suitable selection of an atomizing medium and the carburized steel powder can easily be decarburized by the treatment in the fluidized bed furnace.

Figure 4:
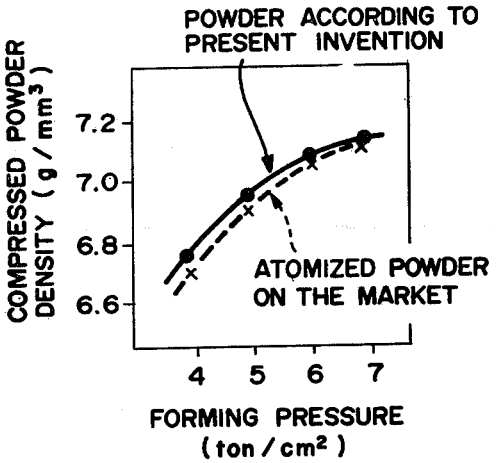
FIG. 4 is a graph showing the compressed powder density of the steel powder produced by the apparatus of this invention.
Figure 5:
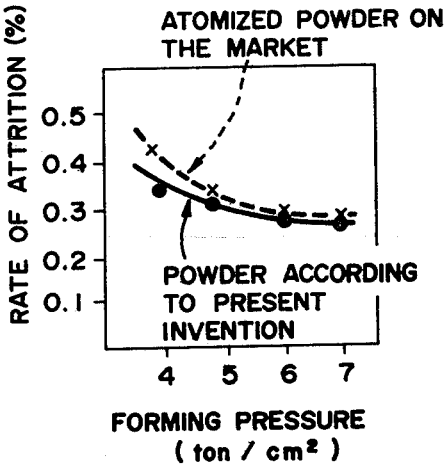
FIG. 5 is a graph showing the rate of attrition of the steel powder produced by the apparatus of this invention.
Figure 6:
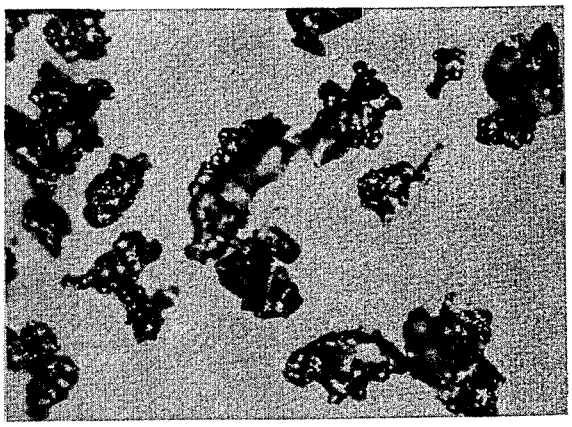
FIG. 6 is a photomicrograph (400 magnifications) showing the shapes of steel particles produced by this invention.

Further the steel powder was tested for compressed powder characteristics. The results of the test concerning the relation between the compressed powder density and the forming pressure are shown in FIG. 4 and concerning the relation the forming pressure and the rate of attrition are shown in FIG. 5. As a lubricant, zinc stearate content of 0.75% was used. For comparison, the steel powder produced by the conventional water atomizing method (having substantially the same chemical composition) was subjected to the similar test and the results are shown in the diagrams. A review of the data given in the diagrams reveals that the steel powder produced by the method of this invention gave results favorably comparable with or even better than the results given by the steel powder of the conventional method. The good results, it is believed, may be ascribable to the fact that the steel powder produced by the method of this invention has a notably low oxygen content than the steel powder produced by the conventional method.

It is evident from the test results described above that the present invention provides an advantageous method and apparatus capable of producing a metal powder having a low oxygen content and a proper particle size distribution and exhibiting desirable compressed powder characteristics and that the method and apparatus of this invention are highly effective in the production of metal powders of not merely steel and steel alloy but also copper, copper alloy, and even titanium and aluminum which have high capacities for oxidation.

What is claimed is:

1. A method of producing a metal powder useful in the making of powder metallurgical articles which comprises the steps of
   (a) providing a stream of a molten metal in a zone containing no atmospheric air,
   (b) contacting the stream of molten metal in the zone containing no atmospheric air with at least one stream of a non-polar solvent so as to cause the stream of molten metal to form into atomized particles of molten metal,
   (c) collecting in a mixture the used non-polar solvent and the formed atomized particles of molten metal from step (b) while preventing atmospheric air from contacting the formed atomized particles of molten metal,
   (d) separating the used non-polar solvent from the formed atomized particles of molten metal contained in the mixture in step (c), and
   (e) separately recovering the non-polar solvent and the formed atomized particles of molten metal obtained in step (d).

2. The method as defined in claim 1 including the step of (f) heat treating the formed atomized particles recovered in step (e) to achieve decarburization and/or softening annealing thereof.

3. The method as defined in claim 2 wherein the non-polar solvent is separated from the formed atomized particles of molten metal in step (d) by passing the mixture downwardly through one or more fluidized bed furnaces and passing a non-oxidizing gas upwardly through the fluidized bed furnaces, the upwardly moving, non-oxidizing gas separating the non-polar solvent from the formed atomized particles of molten metal.

4. The method as defined in claim 3 wherein the non-oxidizing gas is preheated prior to passage upwardly through any of the fluidized bed furnaces, the heat treating of the formed atomized particles defined in step (f) occurring in a first zone of the first fluidized bed furnace through which the preheated non-oxidizing gas passes and the separating of the non-polar solvent from the formed atomized particles of molten metal occurring due to gasification of the non-polar solvent by the upwardly moving non-oxidizing gas in one or more other zones in the fluidized bed furnaces.

5. The method as defined in claim 4 wherein the zone containing no atmospheric air in which the atomized particles of molten metal are formed in step (b) contains a non-oxidizing gas.

6. The method as defined in claim 5 wherein the non-oxidizing gas in the zone in which the atomized particles of molten metal are formed is $N_2$ gas.

7. The method as defined in claim 5 wherein the non-polar solvent is an oil selected from the group consisting of a mineral oil, an animal oil and a vegetable oil.

8. The method as defined in claim 5 wherein the non-polar solvent is an oil selected from the group consisting of a quenching oil, a machine oil and a turbine oil.

9. The method as defined in claim 4 wherein the preheated non-oxidizing gas passed upwardly through the fluidized bed furnace is preheated $N_2$ gas.

10. The method as defined in claim 9 wherein the preheated $N_2$ gas is preheated to at least 850° C. prior to passage into the first fluidized bed furnace.

11. The method as defined in claim 4 wherein the non-polar solvent includes a carburization-preventing agent.

12. The method as defined in claim 4 wherein only one fluidized bed furnace is used.

13. A method of producing a metal powder useful in the making of powder metallurgical articles which comprises the steps of
   (a) providing a stream of a molten metal in a zone containing a non-oxidizing gas,
   (b) contacting the stream of molten metal in the zone containing a non-oxidizing gas with a stream of a non-polar liquid solvent so as to cause the stream of molten metal to form into atomized droplets of molten metal,
   (c) cooling the atomized droplets of molten metal in the zone to form irregularly shaped particles of molten metal,
   (d) collecting the used non-polar liquid solvent and the formed atomized particles of molten metal from step (c) to form a mixture, while at the same time preventing atmospheric air from contacting the formed atomized particles of molten metal,
   (e) draining away from the mixture of step (d) some of the used non-polar liquid solvent, leaving atomized particles of molten metal having non-polar liquid solvent remaining on their surfaces, and
   (f) separating the non-polar liquid solvent left on the surfaces of the atomized particles of molten metal of step (e) and then heat treating the obtained atomized particles of molten metal to achieve decarburization and/or softening annealing by passing the atomized particles of molten metal with non-polar liquid solvent on their surfaces downwardly through a fluidized bed furnace in countercurrent flow to a heated non-oxidizing gas passing upwardly therethrough.

* * * * *